US006698138B1

(12) United States Patent
Lin

(10) Patent No.: US 6,698,138 B1
(45) Date of Patent: Mar. 2, 2004

(54) ADJUSTABLE PULLEY ASSEMBLY FOR A SUSPENDED DOOR

(75) Inventor: Chin Tang Lin, Pingjen (TW)

(73) Assignee: Heade Technology Co., Ltd., Taoyuan (TW)

( * ) Notice: Subject to any disclaimer, the term of this patent is extended or adjusted under 35 U.S.C. 154(b) by 0 days.

(21) Appl. No.: 10/412,073

(22) Filed: Apr. 9, 2003

(51) Int. Cl.[7] ..... E05D 13/00
(52) U.S. Cl. ..... 49/409; 49/425; 16/105
(58) Field of Search ..... 49/409, 410, 404, 49/425; 16/91, 94 R, 97, 105, 106, 107, 96 R

(56) References Cited

U.S. PATENT DOCUMENTS 4,099,599 A * 7/1978 Randall ..... 49/409
5,070,575 A * 12/1991 Redman et al. ..... 49/425
6,336,247 B1 * 1/2002 Schnoor ..... 49/425

* cited by examiner

*Primary Examiner*—Jerry Redman
(74) *Attorney, Agent, or Firm*—Pro-Techtor International Services

(57) ABSTRACT

An adjustable pulley assembly includes a fixing plate securely mounted on top of an upper frame of a suspended door, an adjusting seat mounted to the fixing plate, a pulley seat securely attached to the adjusting seat to move therewith, a pulley attached to the pulley seat, and an adjusting bolt. An axle is extended through the pulley, a screw hole in the pulley seat, and a vertical slot in the adjusting seat, and a nut is engaged on a distal end of the axle. An adjusting bolt is extended through a hole in a top plate of the pulley seat and a screw hole in a top plate of the adjusting seat. A distance between the top plate of the pulley seat and the top plate of the adjusting seat is changed when the adjusting bolt is turned.

7 Claims, 9 Drawing Sheets

ADJUSTABLE PULLEY ASSEMBLY FOR A SUSPENDED DOOR

BACKGROUND OF THE INVENTION

1. Field of the Invention

The present invention relates to an adjustable pulley assembly for a suspended door such as an aluminum door, stainless steel door, wooden door, glass door, or automatic door.

2. Description of the Related Art

A suspended door is generally used in public places that require frequent opening and closing of the door. An advantage of the suspended door is that it is not necessary to install a track or guide groove on the floor for the door, which provides an aesthetically pleasing effect and allows easy cleaning of the floor. Another advantage of the suspended door is that it is easy to design the drive device for the suspended door. In particular, easy control of forward/rearward movement of the suspended door can be easily achieved through the use of a motor mounted to a track above the door frame and control circuits. Hence, electric doors used in public places generally employ suspended doors.

Conventionally, a set of pulley assembly is mounted to each of a left side and a right side of a top portion of a suspended door so as to hang the door on the track. After installation of the suspended door, it is necessary to adjust the position of the suspended door in the left/right direction and/or the vertical direction. The suspended door, which weights up to 100 kg, is lifted by labor for proceeding with adjustment of the position of the axle of the pulley. Another solution is detaching the suspended door, proceeding with required adjustment, and then reinstalling the suspended door. Yet it is troublesome and causes a waste of time and labor while the adjustment may not be precise.

SUMMARY OF THE INVENTION

An object of the present invention is to provide an adjustable pulley assembly for a suspended door that allows easy adjustment of the position of the suspended door in the left/right direction and/or vertical direction.

Another object of the present invention is to provide an adjustable pulley assembly for a suspended door that is suitable for use with a belt assembly and an anti-disengagement arrangement.

A further object of the present invention is to provide an adjustable pulley assembly for a suspended door that is reliable, durable, and force-saving to operation.

An adjustable pulley assembly for a suspended door in accordance with the present invention includes a fixing plate securely mounted on top of an upper frame of a suspended door, an adjusting seat mounted to the fixing plate, a pulley seat securely attached to the adjusting seat to move therewith, a pulley attached to the pulley seat, and an adjusting bolt.

The adjusting seat includes a first vertical plate having an upper end and a lower end, a top plate extending from the upper end of the first vertical plate along a direction transverse to the first vertical plate, and a bottom plate extending from the bottom end of the first vertical plate along a direction opposite to the extending direction of the top plate. The first vertical plate includes a vertical slot, and the top plate includes a screw hole.

The pulley seat includes a second vertical plate and a top plate extending from an upper end of the second vertical plate along a direction transverse to the second vertical plate. The second vertical plate has a screw hole, and the top plate of the pulley seat has a hole aligned with the screw hole of the top plate of the adjusting seat.

The pulley includes a bearing mounted therein. An axle extends through the pulley and extends through the screw hole of the vertical plate of the pulley seat and the vertical slot of the adjusting seat, with a nut engaged on a distal end of the axle. The pulley is mounted on a guide rail of a track along which the suspended door moves. The adjusting bolt extends through the hole of the top plate of the pulley seat and the screw hole of the top plate of the adjusting seat.

When the adjusting bolt is turned, the vertical slot of the first vertical plate of the adjusting seat allows relative movement between the top plate of the pulley seat and the top plate of the adjusting seat in the vertical direction, thereby changing a distance between the top plate of the pulley seat and the top plate of the adjusting seat.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
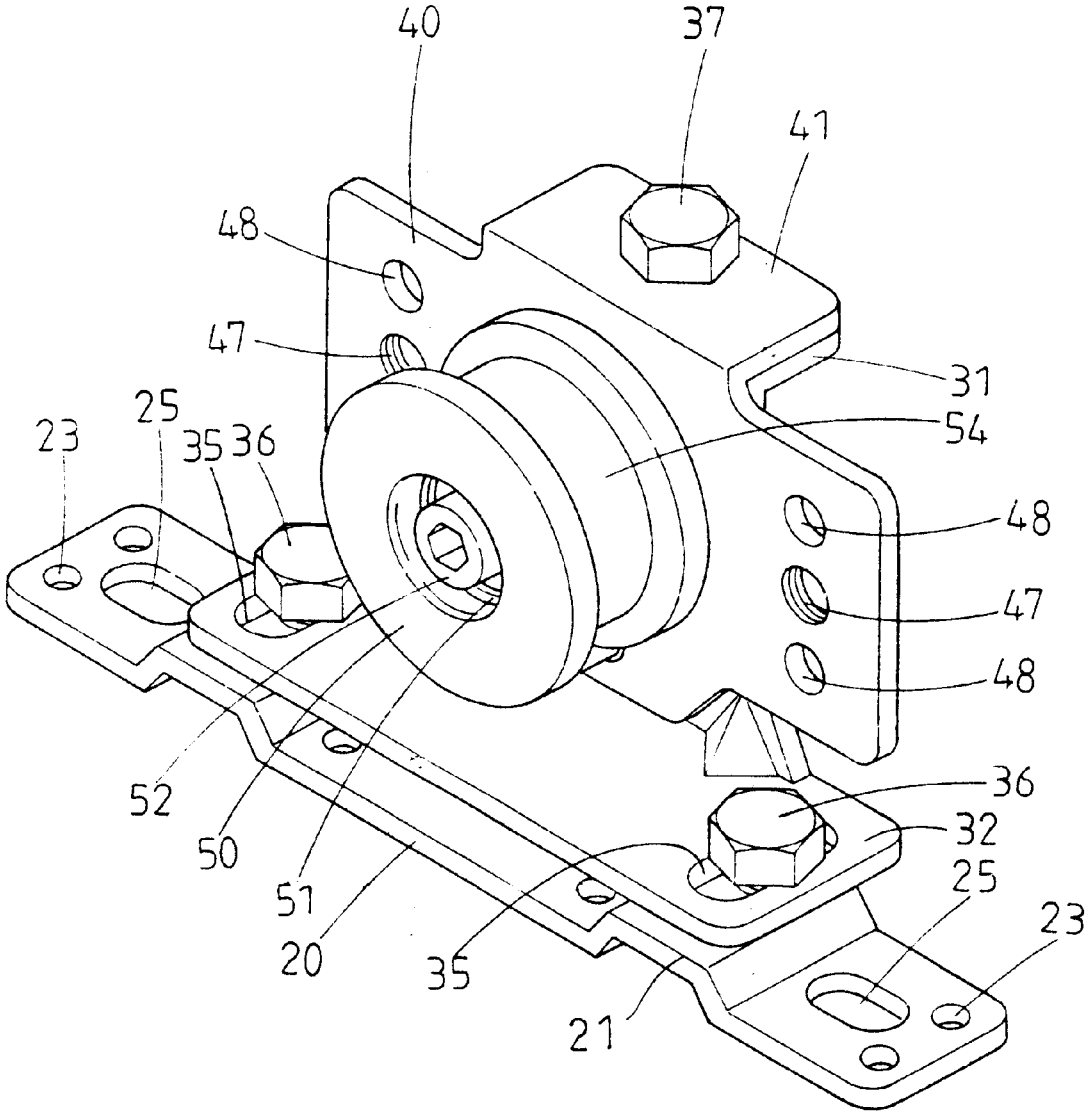
FIG. 1 is a perspective view of an adjustable pulley assembly for a suspended door in accordance with the present invention.
Figure 2:
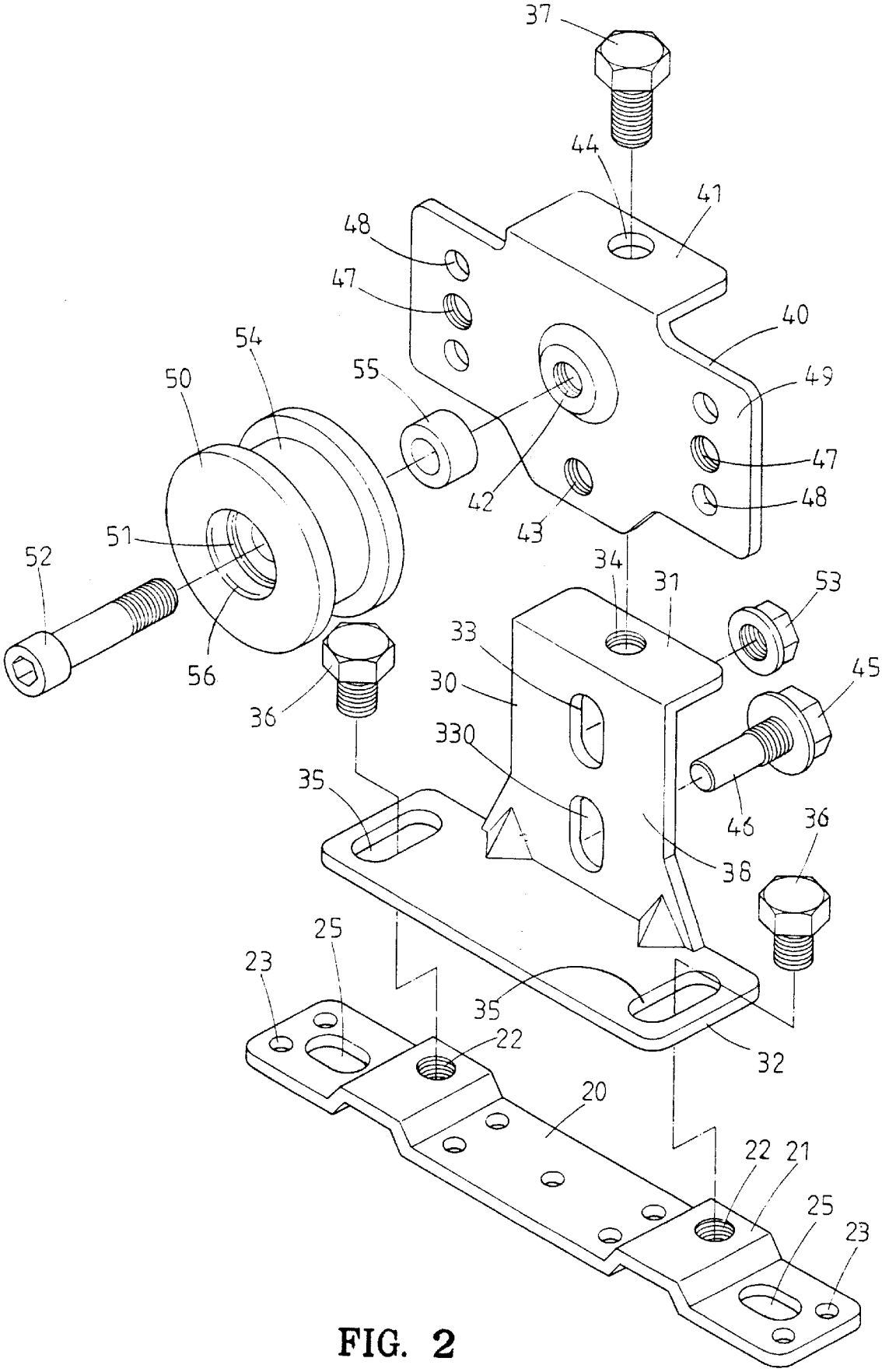
FIG. 2 is an exploded perspective view of the adjustable pulley assembly for a suspended door in accordance with the present invention.
Figure 3:
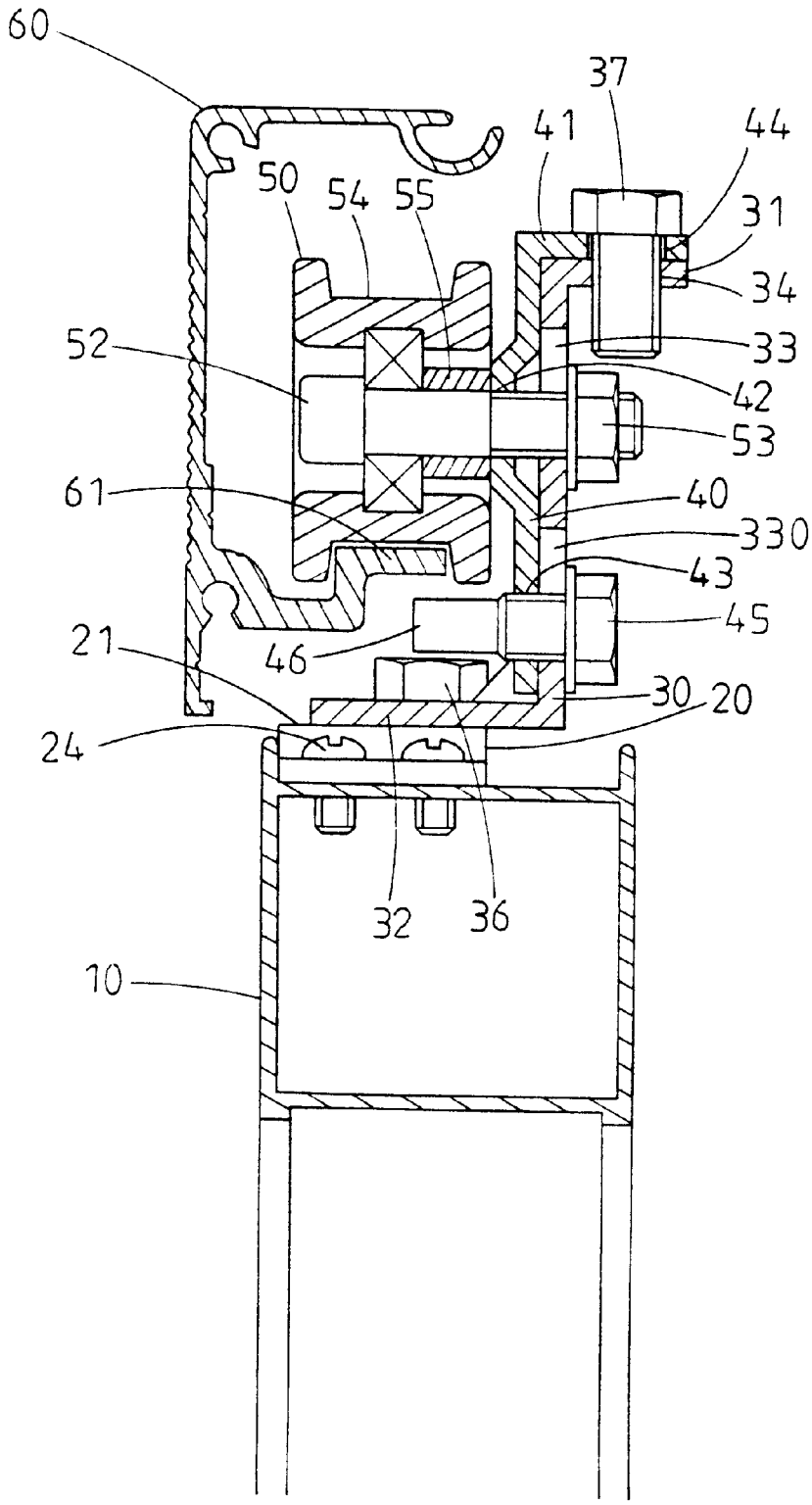
FIG. 3 is a sectional view illustrating use of adjustable pulley assembly for a suspended door in accordance with the present invention.

Referring to FIGS. 1 through 3, an adjustable pulley assembly in accordance with the present invention is mounted to an end (e.g., left end or right end) of a top of a suspended door 10 and generally comprises a fixing plate 20, an adjusting seat 30, a pulley seat 40, a pulley 50, and an adjusting bolt 37. It is noted that a suspended door 10 generally has two pulley assemblies attached to the top thereof to provide a uniform, balanced support for the suspended door 10. Nevertheless, a single pulley assembly having a sufficiently strong support can be used without departing the scope of the invention. The position of a suspended door 10 to which the adjustable pulley assembly is mounted can be adjusted in a front/rear direction and/or vertical direction, which will be described later.

Figure 6:
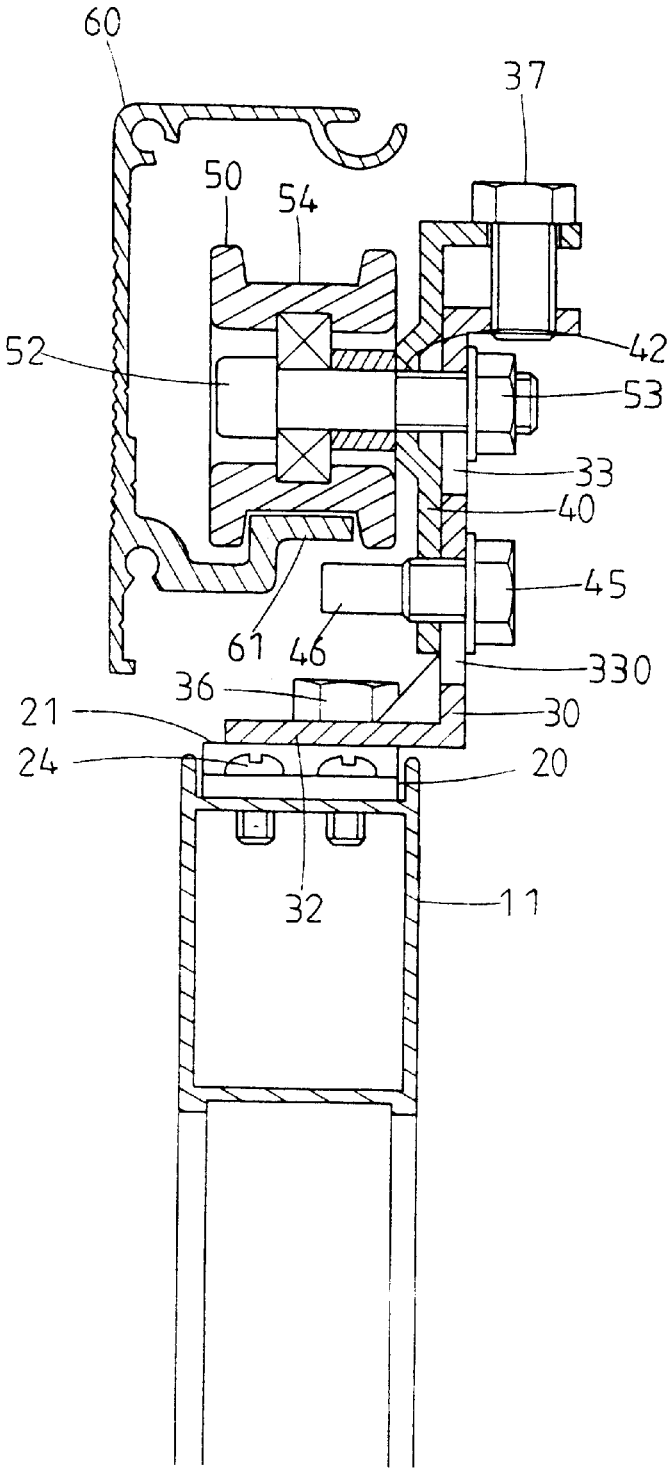
FIG. 6 is a sectional view similar to FIG. 4, illustrating use of the adjustable pulley assembly with a narrower suspended door.

The fixing plate 20 includes two ends each having holes 23 and an elongated hole 25. Bolts 24 (FIG. 3) are selectively extended through the holes 23 or the elongated holes 25 for mounting the fixing plate 20 to a top of an upper frame of a wider suspended door 10 (FIG. 3) or of a narrower suspended door 11 (FIG. 6). Further, the fixing plate 20 includes two elevated sections 21 between the ends thereof, with each elevated section 21 having a screw hole 22. The elevated sections 21 are spaced apart by an intermediate portion (not labeled) of the fixing plate 20.

The adjusting seat 30 is a substantially vertical plate 38 having two vertically spaced vertical slots 30 and 330. The adjusting seat 30 further has a top plate 31 extending from an upper end of the vertical plate 38 along a direction transverse (preferably perpendicular) to the vertical direction. A screw hole 34 is defined in the top plate 31. The adjusting seat 30 further has a bottom plate 32 extending from a lower end of the vertical plate 38 along a direction transverse (preferably perpendicular) to the vertical direction and opposite to the extending direction of the top plate 31. An elongated hole 35 is defined in each of two ends of the bottom plate 32. A bolt 36 is extended through each elongated hole 35 of the bottom plate 32 and then engaged with the screw hole 22 of an associated elevated section 21 of the fixing plate 20, allowing adjustment of the position of the suspended door 10 in the front/rear direction (i.e., the moving direction of the suspended door 10). The elevated sections 21 of the fixing plate 20 provide spaces for receiving the heads (not labeled) of the bolts 24 and the threaded shank (not labeled) of the bolts 36.

The pulley seat 40 includes a vertical plate 49 and a top plate 41 extending from an upper end of the vertical plate 49 along a direction transverse (preferably perpendicular) to the vertical direction. The top plate 41 of the pulley seat 40 abuts against on top of the top plate 31 of the adjusting seat 30, with a hole 44 in the top plate 41 aligned with the screw hole 34 of the adjusting seat 30. The vertical plate 49 has an upper screw hole 42 and a lower screw hole 43 in an intermediate portion thereof. The screw holes 42 and 43 are respectively aligned with the vertical slots 30 and 330 of the vertical plate 38 of the adjusting seat 30.

The pulley 50 includes an annular groove 54 in an outer periphery thereof and a bore 56 that receives a bearing 51 therein. As illustrated in FIG. 3, the pulley is attached to the vertical plate 49 of the pulley seat 40 by means of extending an axle 52 through the bearing 51, the upper screw hole 42 of the vertical plate 49 of the pulley seat 40, and the upper vertical slot 33 of the vertical plate 38 of the adjusting seat 30. A nut 53 is engaged with a distal portion of a threaded shank (not labeled) of the axle 52 to prevent disengagement. Further, a collar 55 is mounted around the axle 52 and located between the vertical plate 49 of the pulley seat 40 and an end face (not labeled) of the bearing 51. Further, an adjusting bolt 37 is extended through the screw hole 34 of the top plate 31 of the adjusting seat 30 and the hole 44 of the top plate 41 of the pulley seat 40. Further, a bolt 45 is extended through the lower screw hole 43 of the vertical plate 49 of the pulley seat 40 and the lower vertical slot 330 of the vertical plate 38 of the adjusting seat 30. The bolt 45 has a distal, protruded portion located below the pulley 50 for preventing the adjustable pulley assembly from being disengaged from a track 60 for the suspended door 10. Still referring to FIG. 3, the track 60 is fixed to a wall (not shown) of a building (not shown) and has a guide rail 61 for engaging with the annular groove 54 of the pulley 50. Thus, the pulley 50 and the whole adjustable pulley assembly are movable along the guide rail 61 for opening/closing the suspended door 10 that is fixed to the fixing plate 20. Preferably, a bottom wall delimiting the annular groove 54 is smooth and wide and designed complimentary to a top face of the guide rail 61 to thereby increase the area for supporting the weight of the suspended door 10 and to thereby provide a durable structure. Since the axle 52 for the pulley 50 is directly extended through the upper screw hole 42 of the pulley seat 40 and the nut 53, since the bolt 45 is extended through the lower vertical slot 330 of the adjusting seat 30 and the lower screw hole 43 of the pulley seat 40, and since the adjusting bolt 37 is extended through the hole 44 of the pulley seat 40 and the screw hole 34 of the adjusting seat 30, the adjustable pulley assembly is improved in strength and more durable.

Figure 4:
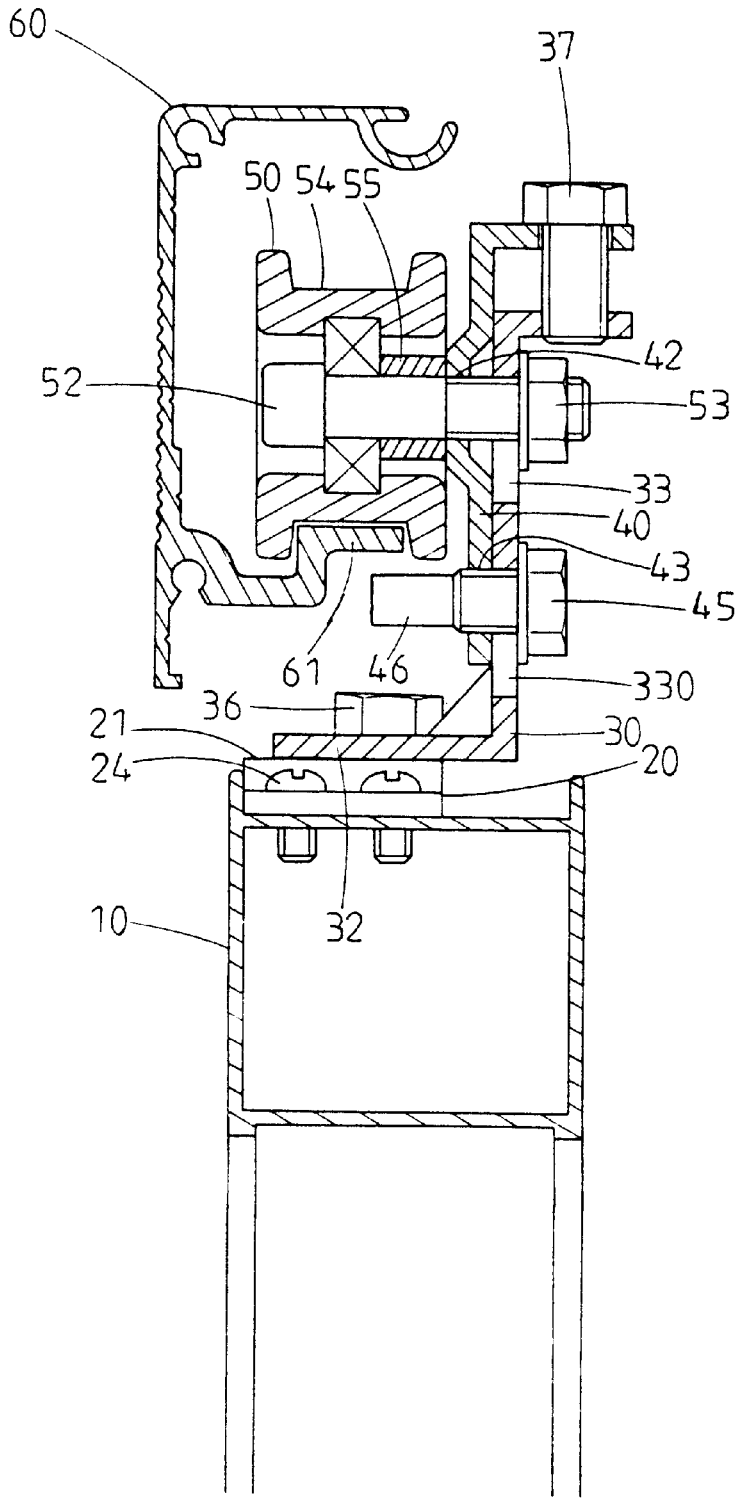
FIG. 4 is a sectional view similar to FIG. 3, illustrating adjustment of the position of the suspended door in the vertical direction.
Figure 5:
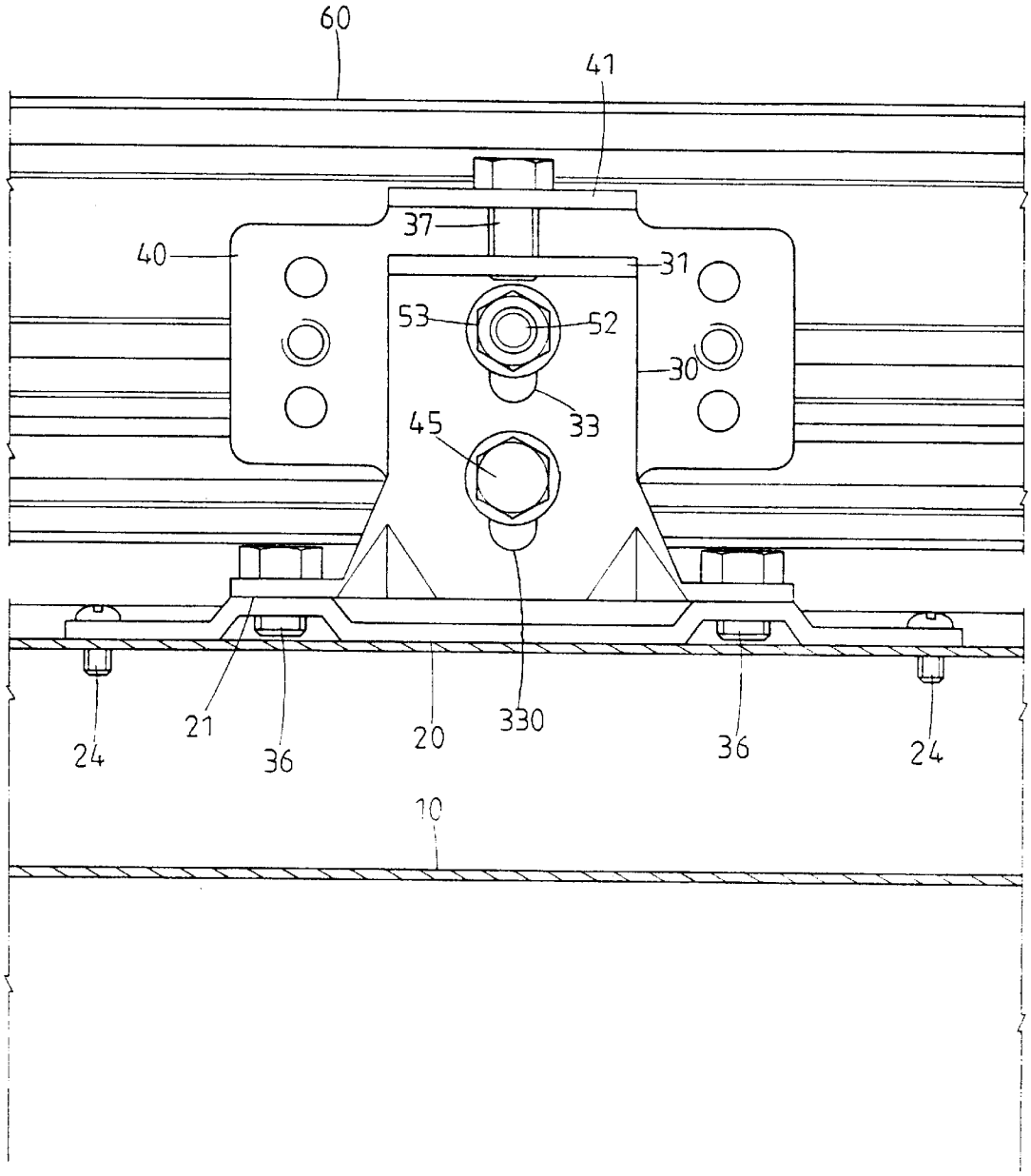
FIG. 5 is a side view of the arrangement in FIG. 4.

FIGS. 4 and 5 illustrate adjustment operation of the adjustable pulley assembly in accordance with the present invention. If adjustment is required after installation of the suspended door 10, the nut 53 engaged on the distal end of the threaded portion of the axle 52 is loosened and the bolt 45 is loosened to allow direct turning of the adjusting bolt 37. Due to provision of the vertical slots 33 and 330, the vertical position of the left side (or the right side) of the suspended door 10 can be directly adjusted through turning of the adjusting bolt 37. Namely, the upper vertical slot 33 of the vertical plate 30 of the adjusting seat 30 allows relative movement between the top plate 41 of the pulley seat 40 and the top plate 31 of the adjusting seat 30 in the vertical direction, thereby changing a distance between the top plate 41 of the pulley seat 40 and the top plate 31 of the adjusting seat 30.

A distance between a central axis of the axle 52 and a central axis of the bolt 45 is so determined (basing on a diameter of the pulley 50 and the dimension of the guide rail 61) that the distal, protruded end of the bolt 45 is located below and spaced from the guide rail 61 by an appropriate distance. Thus, the suspended door 10 is prevented from being disengaged from the guide rail 61 when the suspended door 10 is subject to an external force. In an embodiment of the invention, the distal, protruded end of the bolt 45 is in the form of a smooth round shank 46 having a reduced diameter.

Figure 7:
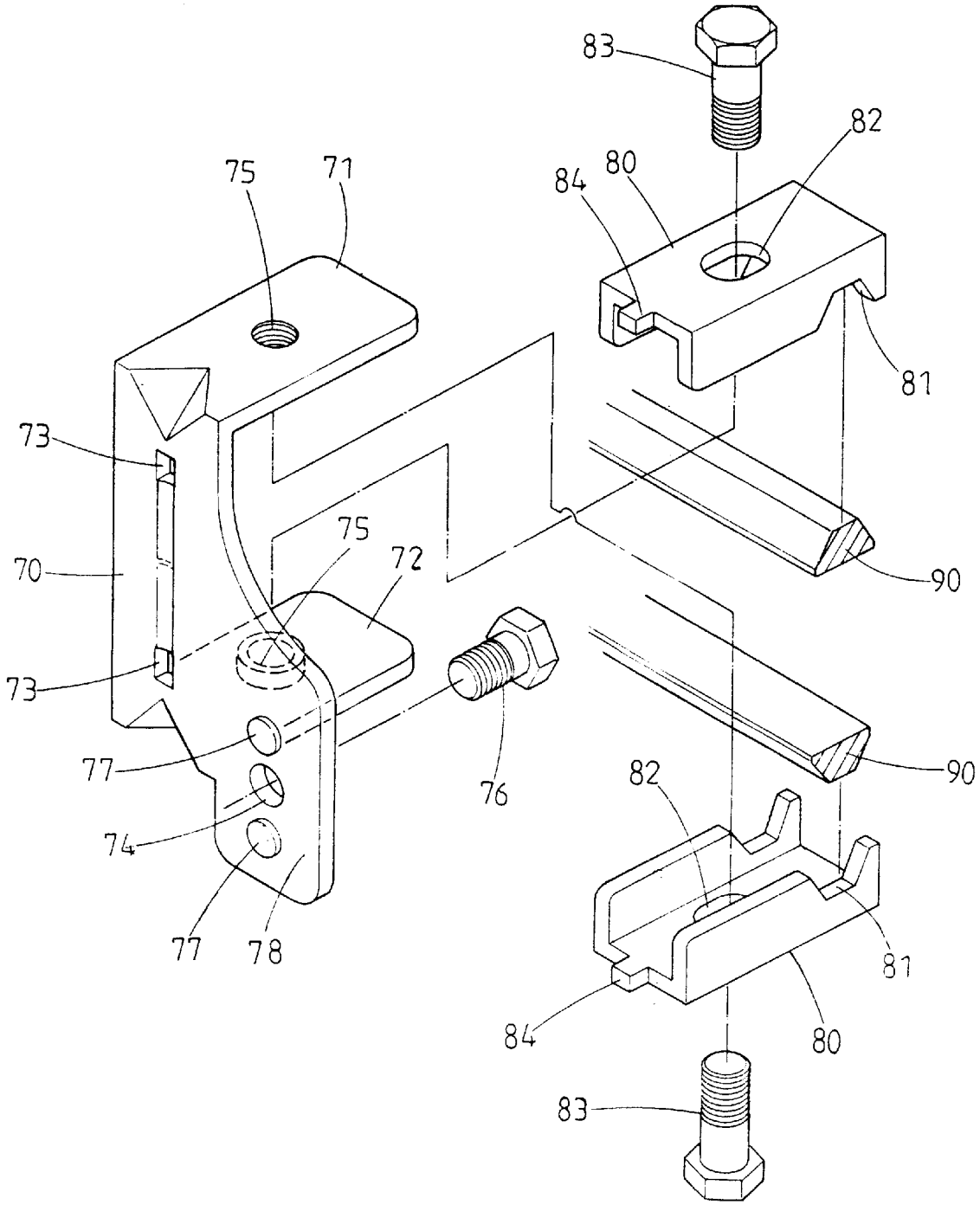
FIG. 7 is an exploded perspective view of a belt frame used with the adjustable pulley assembly in accordance with the present invention.
Figure 8:
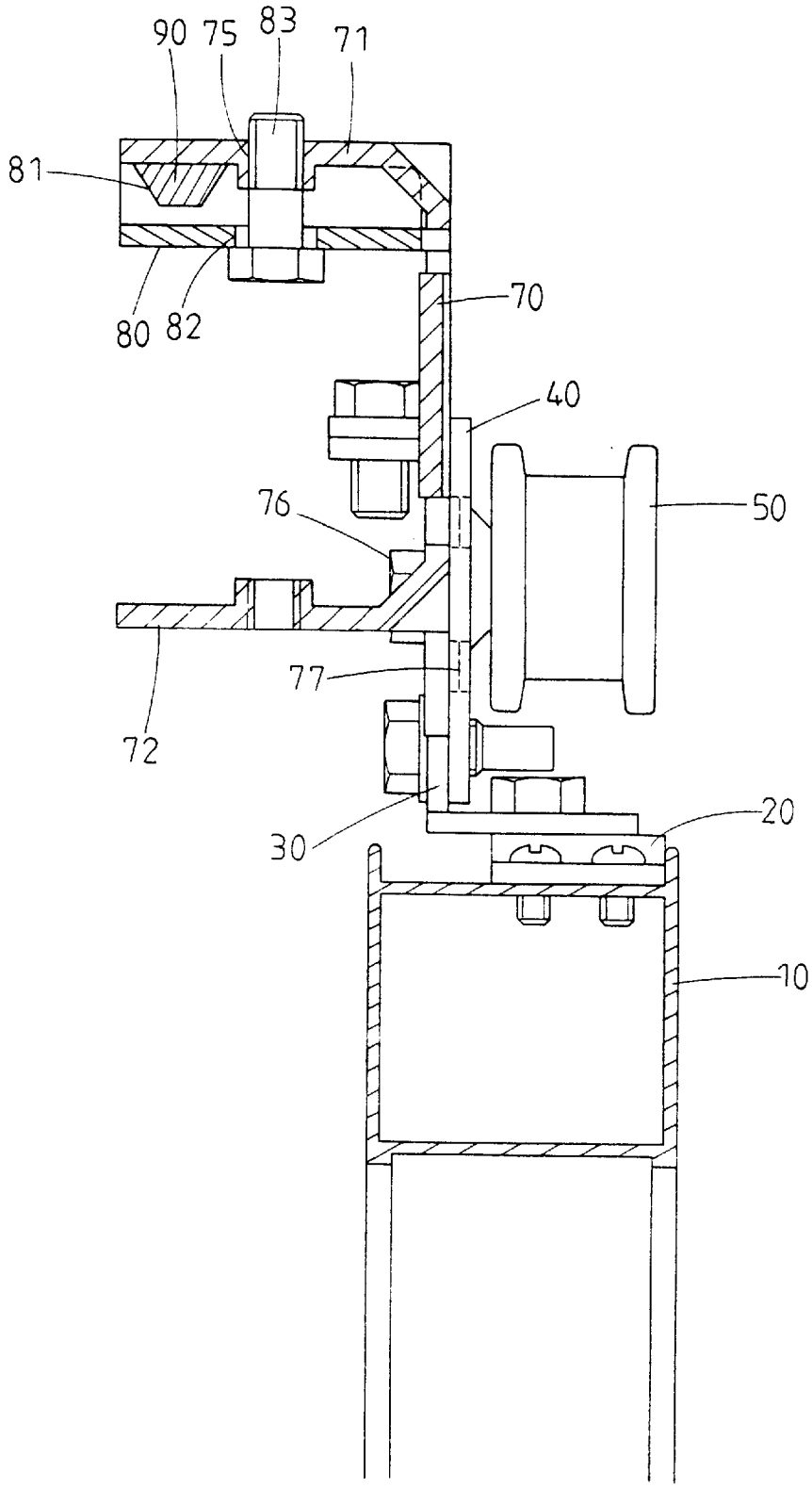
FIG. 8 is a sectional view illustrating mounting of the belt frame to the adjustable pulley assembly for an electric suspended door.
Figure 9:
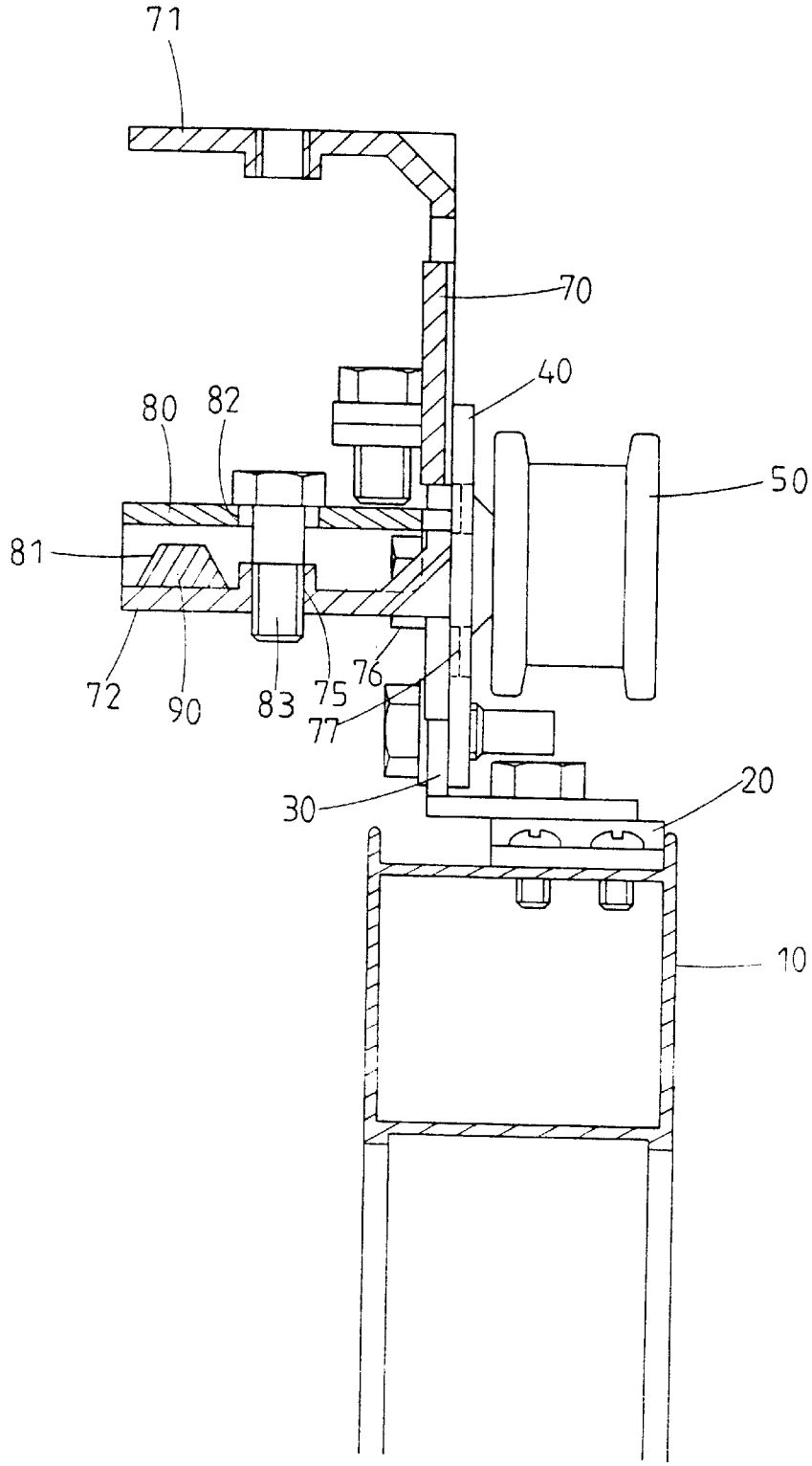
FIG. 9 is a sectional view illustrating another mounting of the belt frame to the adjustable pulley assembly for an electric suspended door.

FIG. 7 is an exploded perspective view of a belt frame used with the adjustable pulley assembly in accordance with the present invention. FIG. 8 is a sectional view illustrating mounting of the belt frame to the adjustable pulley assembly for an electric suspended door. FIG. 9 is a sectional view illustrating another mounting of the belt frame to the adjustable pulley assembly for an electric suspended door.

As illustrated in FIG. 2, the vertical plate 49 of the pulley seat 40 has a pair of vertically spaced apart holes 48 in each of two sides thereof and a screw hole 47 between each pair of holes 48. As illustrated in FIG. 7, the belt frame 70 includes a vertical section 78 having two round protrusions 77 on a lower portion thereof, with a hole 74 defined between the protrusions 77. The protrusions 77 are engaged with the holes 48 on one of the sides of the vertical plate 49 of the pulley seat 40, and a bolt 76 is extended through the hole 74 of the belt frame 70 and the associated screw hole 47 of the vertical plate 49 of the pulley seat 40. Thus, the belt frame 70 is fixed to the pulley seat 40 to move therewith. A top extension plate 71 extends from an upper end of the vertical section 78 along a direction perpendicular to the vertical direction and has a screw hole 75. A bottom extension plate 72 extends from the lower portion of the vertical section 78 along a direction perpendicular to the vertical direction and has a screw hole 75.

A fixing member 80 is provided for mounting an endless belt 90 for transmission. As illustrated in FIG. 7, the fixing member 80 is substantially U-shaped and includes an elongated hole 82 in an intermediate portion thereof, a guide block 84 on an end of the intermediate portion thereof, and a recessed portion 81 located in a position opposite to the guide block 84. The endless belt 90 is extended through and securely held by the recessed portion 81 of the fixing member 80. As illustrated in FIG. 8, a bolt 83 is extended through the elongated hole 82 of the fixing member 80 and the screw hole 75 of the top extension plate 71, thereby securely attaching the adjustable pulley assembly to an upper section of the endless belt 90 for transmission. FIG. 9 illustrates an alternative arrangement of the fixing member 80, wherein the fixing member 80 is attached to the lower extension plate 72 of the belt frame 70, thereby securely attaching the adjustable pulley assembly to the lower section of the endless belt 90.

The vertical section 78 of the belt frame 70 includes an upper guide opening 73 and a lower guide opening 73 for selectively engaging with the guide block 84 of the fixing member 80, thereby allowing adjustment of the position of the fixing member 80 in the front/rear direction.

It is noted that the adjustable pulley assembly in accordance with the present invention allows the vertical position of the left side and the right side of the suspended door 10, 11 to be quickly adjusted and the adjustment is force-saving. Further, the adjustable pulley assembly in accordance with the present invention provides a reliable and durable structure and can be used with a belt frame. Further, the adjustable pulley assembly in accordance with the present invention prevents the suspended door 10, 11 from being disengaged from the guide rail 61.

Although the invention has been explained in relation to its preferred embodiment, it is to be understood that many other possible modifications and variations can be made without departing from the scope of the invention as hereinafter claimed.

What is claimed is:

1. An adjustable pulley assembly for a suspended door, the adjustable pulley assembly comprising:

a fixing plate adapted to be securely mounted on top of an upper frame of the suspended door;

an adjusting seat mounted to the fixing plate, the adjusting seat including a first vertical plate having an upper end and a lower end, a top plate extending from the upper end of the first vertical plate along a direction transverse to the first vertical plate, and a bottom plate extending from the bottom end of the first vertical plate along a direction opposite to the extending direction of the top plate, the first vertical plate including a vertical slot, the top plate including a screw hole;

a pulley seat securely attached to the adjusting seat to move therewith, the pulley seat including a second vertical plate and a top plate extending from an upper end of the second vertical plate along a direction transverse to the second vertical plate, the second vertical plate having a screw hole, the top plate of the pulley seat having a hole aligned with the screw hole of the top plate of the adjusting seat;

a pulley including a bearing mounted therein, an axle extending through the pulley and extending through the screw hole of the vertical plate of the pulley seat and the vertical slot of the adjusting seat, with a nut engaged on a distal end of the axle, the pulley being adapted to be mounted on a guide rail of a track along which the suspended door moves; and an adjusting bolt extending through the hole of the top plate of the pulley seat and the screw hole of the top plate of the adjusting seat;

wherein when the adjusting bolt is turned, the vertical slot of the first vertical plate of the adjusting seat allows relative movement between the top plate of the pulley seat and the top plate of the adjusting seat in the vertical direction, thereby changing a distance between the top plate of the pulley seat and the top plate of the adjusting seat.

2. The adjustable pulley assembly for a suspended door as claimed in claim 1, wherein the fixing plate includes two elevated sections between two ends thereof, each said elevated section including a screw hole, the bottom plate of the adjusting seat including an elongated hole in each of two ends thereof, with a bolt extending through each said elongated hole and the screw hole of an associated one of the elevated sections, thereby allowing a position of the adjusting seat relative to the fixing member in a front and rear direction, each said end of the fixing member further having an elongated hole and at least one hole through which a bolt is selectively extended to fix the fixing plate on top of the upper frame of the suspended door at a desired position.

3. The adjustable pulley assembly for a suspended door as claimed in claim 1, wherein the pulley includes an annular groove in an outer periphery thereof, a bottom wall delimiting the annular groove being smooth.

4. The adjustable pulley assembly for a suspended door as claimed in claim 1, wherein the first vertical plate of the adjusting seat includes a further vertical slot, the pulley seat having a screw hole aligned with the further vertical slot, a further bolt being extended through the screw hole of the pulley seat and the further vertical slot of the adjusting seat, the further bolt having a distal, protruded section located below the guide rail and spaced from the guide rail by a small distance.

5. The adjustable pulley assembly for a suspended door as claimed in claim 4, wherein the distal, protruded section of the further bolt is a smooth shank.

6. The adjustable pulley assembly for a suspended door as claimed in claim 1, further including a belt frame securely attached to a side of the pulley seat, the belt frame including a vertical plate and an extension plate extending from one of an upper end and a lower end of the vertical plate of the belt frame, a fixing member being securely mounted to the extension plate and including a recessed section for securely holding a belt for transmission.

7. The adjustable pulley assembly for a suspended door as claimed in claim 6, wherein the fixing member is substantially U-shaped and has an elongated hole in an intermediate portion thereof, with a bolt extending through the elongated hole, allowing adjustment of a position of the fixing member in a front and rear direction.

* * * * *